US009725850B2

(12) United States Patent
Tamura

(10) Patent No.: US 9,725,850 B2
(45) **Date of Patent: *Aug. 8, 2017**

(54) WET PAPER WEB TRANSFER BELT, PAPERMAKING SYSTEM, PAPERMAKING METHOD AND METHOD FOR PRODUCING A WET PAPER WEB TRANSFER BELT

(71) Applicant: Ichikawa Co., Ltd., Bunkyo-ku (JP)

(72) Inventor: Ai Tamura, Bunkyo-ku (JP)

(73) Assignee: Ichikawa Co., Ltd., Bunkyo-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/849,063

(22) Filed: Sep. 9, 2015

(65) Prior Publication Data

US 2016/0097159 A1 Apr. 7, 2016

(30) Foreign Application Priority Data

Oct. 1, 2014 (JP) ..... 2014-203369

(51) Int. Cl.
*D21F 1/00* (2006.01)
*D21F 7/08* (2006.01)

(52) U.S. Cl.
CPC ..... *D21F 1/0027* (2013.01); *D21F 7/086* (2013.01)

(58) Field of Classification Search
USPC ..... 162/204, 289, 361
IPC ..... D21F 1/00,2/00
See application file for complete search history.

(56) References Cited

U.S. PATENT DOCUMENTS

| | | | | |
|---|---|---|---|---|
| 5,298,124 | A | 3/1994 | Eklund | |
| 2006/0207739 | A1* | 9/2006 | Takamura | D21F 1/325 162/361 |
| 2009/0297972 | A1* | 12/2009 | Sakimura | G03G 5/14704 430/66 |
| 2014/0076510 | A1 | 3/2014 | Inoue | |
| 2014/0076511 | A1 | 3/2014 | Inoue | |
| 2015/0218751 | A1* | 8/2015 | Inoue | D21F 7/086 162/289 |
| 2015/0218752 | A1* | 8/2015 | Inoue | D21F 7/086 162/289 |

FOREIGN PATENT DOCUMENTS

| | | |
|---|---|---|
| DE | 10 2006 040 056 A1 | 2/2008 |
| EP | 1 069 235 A1 | 1/2001 |
| EP | 1 703 016 A1 | 9/2006 |
| EP | 2 711 458 A1 | 3/2014 |
| JP | 6-57678 | 3/1994 |
| JP | 2014-62337 | 4/2014 |
| JP | 2014-62338 | 4/2014 |

* cited by examiner

*Primary Examiner* — Mark Halpern
(74) *Attorney, Agent, or Firm* — Oblon, McClelland, Maier & Neustadt, L.L.P.

(57) ABSTRACT

A wet paper web transfer belt for transferring a wet paper web. The belt has a wet paper web carrying surface carrying a wet paper web which is made of a resin layer. The skewness Rsk of the roughness curve of the wet paper web carrying surface is −0.5 or less.

6 Claims, 2 Drawing Sheets

WET PAPER WEB TRANSFER BELT, PAPERMAKING SYSTEM, PAPERMAKING METHOD AND METHOD FOR PRODUCING A WET PAPER WEB TRANSFER BELT

TECHNICAL FIELD

The present invention relates to a wet paper web transfer belt, a papermaking system, a papermaking method and a method for producing a wet paper web transfer belt.

DESCRIPTION OF THE RELATED ART

Papermaking machines removing moisture from the source material of paper are generally equipped with a wire part, a press part and a dryer part. These parts are arranged in the order of wire part, press part and dryer part in the wet paper web transfer direction.

Regarding the passing of the wet paper web in the press part, at present, closed-draw papermaking machines are known in which the wet paper web is passed in a closed draw. In the press part of the closed-draw papermaking machine, the wet paper web is transferred while being placed on a papermaking felt or a wet paper web transfer belt; therefore, there are no places in which the wet paper web travels on its own and the occurrence of web breaks can be prevented. Thus, closed-draw papermaking machines are advantageous with regard to high operating speeds and operational stability.

On the other hand, when the wet paper web is passed between wet paper web transfer belts or felts in the press part of such a closed-draw papermaking machine, the "paper robbing" phenomenon may occur in which the wet paper web gets stuck at a wet paper web transfer belt or felt and is not passed to the next wet paper web transfer belt or felt. When the paper robbing phenomenon occurs, operations need to be stopped and the setting of the device needs to be changed so that the wet paper web is passed as it should be.

A number of studies have been carried out regarding wet paper web transfer belts in order to improve the wet paper web transfer properties and to prevent the paper robbing phenomenon in the press part (for example, patent documents 1 to 4). In patent documents 1 to 3, belts are studied in which the wet paper web transfer properties have been improved by setting the belt surface roughness Ra or Rz within a predetermined range. In patent document 4, a belt is studied in which the wet paper web transfer properties have been improved by providing a porous outer layer of the belt.

PRIOR ART DOCUMENTS

Patent Documents

Patent Document 1: JP 2014-62337 (A)
Patent Document 2: JP 2014-62338 (A)
Patent Document 3: JP H06-57678 (A)
Patent Document 4: EP 1069235 (A)

SUMMARY OF THE INVENTION

Problems to be Solved by the Invention

Nevertheless, further improvements of the wet paper web transfer properties are required as the operating speeds of papermaking machines increase.

Therefore, the object of the present invention is to provide a wet paper web transfer belt having excellent wet paper web transfer properties wherein the paper robbing phenomenon in the press part is prevented, a papermaking system having excellent operational stability comprising said wet paper web transfer belt, a papermaking method having excellent operational stability using said wet paper web transfer belt, and a method for producing said wet paper web transfer belt.

Means for Solving Said Problems

The present inventor, as a result of intensive studies to achieve the above object, found out that the adhesive properties of the wet paper web in relation to the wet paper web transfer belt are important when the wet paper web transfer belt receives the wet paper web and that said adhesive properties are improved when the smoothness of the wet paper web carrying surface of the wet paper web transfer belt is high, and that the release properties of the wet paper web in relation to the wet paper web transfer belt are important when the wet paper web transfer belt passes the wet paper web and that said release properties are improved when the wet paper web carrying surface is relatively rough, and have thus achieved said object.

Then, the present inventor, as a result of having further studied the complementary of the conflicting roughness conditions of the wet paper web carrying surface relating to the adhesive and release properties, found out that excellent adhesive properties and release properties of the wet paper web can both be achieved by setting the skewness of the roughness curve of the wet paper web carrying surface within a predetermined range, and have thus completed the invention.

In other words, the present invention relates to the following:

(1) A wet paper web transfer belt for transferring a wet paper web; wherein it comprises a wet paper web carrying surface carrying a wet paper web, which is made of a resin layer, and wherein the skewness Rsk of the roughness curve of the wet paper web carrying surface is −0.5 or less.

(2) The wet paper web transfer belt according to (1); wherein Rsk is between −2.7 and −0.5.

(3) The wet paper web transfer belt according to (1) or (2); wherein the arithmetic average roughness Ra of the wet paper web carrying surface is between 2.0 and 12.0 μm.

(4) A papermaking system comprising a press part squeezing moisture from a wet paper web; wherein the press part is configured so that, in at least one part thereof, a wet paper web transfer belt according to any one of (1) to (3) is used in a closed draw so as to pass a wet paper web.

(5) The papermaking system according to (4); wherein the press part is configured so that, in at least one part thereof, the wet paper web is passed in a closed draw between a wet paper web transfer belt and felt.

(6) A papermaking method comprising a step of squeezing moisture from a wet paper web which is formed by dewatering a pulp slurry; wherein a wet paper web transfer belt according to any one of (1) to (3) is used in said step for passing a wet paper web in a closed draw.

(7) The papermaking method according to (6); wherein, in the step of squeezing moisture, the wet paper web is passed in a closed draw between a wet paper web transfer belt and felt.

(8) A method for producing a wet paper web transfer belt for transferring a wet paper web; wherein it comprises a step of forming a resin layer, and a step of polishing the surface of the resin layer in two stages successively using a $1^{st}$ abrasive and a $2^{nd}$ abrasive of a finer grit than the $1^{st}$ abrasive, to form a wet paper web carrying surface for carrying a wet paper web.

(9) A method for producing a wet paper web transfer belt for transferring a wet paper web; wherein it comprises a resin layer forming step of forming a resin layer, a $1^{st}$ polishing step of polishing the surface of said resin layer using an abrasive having a grit of #120 or less, and a $2^{nd}$ polishing step of polishing said surface using an abrasive having a grit of #240 or more.

(10) The method for producing a wet paper web transfer belt according to (9); wherein the $1^{st}$ polishing step and the $2^{nd}$ polishing step are performed consecutively.

(11) A method for producing a wet paper web transfer belt for transferring a wet paper web; wherein it comprises a resin layer forming step of forming a resin layer, a $1^{st}$ polishing step of polishing the surface of said resin layer using a $1^{st}$ abrasive, and a $2^{nd}$ polishing step of polishing said surface using a $2^{nd}$ abrasive of a finer grit than the $1^{st}$ abrasive; wherein the $1^{st}$ polishing step and the $2^{nd}$ polishing step are performed consecutively, and the difference between the grit of the abrasive used in the $1^{st}$ polishing step and the grit of the abrasive used in the $2^{nd}$ polishing step is #120 or more.

(12) A wet paper web transfer belt produced by a method for producing a wet paper web transfer belt according to any one of (8) to (11).

Advantages of the Invention

By means of the constitution described above, it is possible to provide a wet paper web transfer belt having excellent wet paper web transfer properties wherein the paper robbing phenomenon in the press part is prevented, a papermaking system having excellent operational stability comprising said wet paper web transfer belt, a papermaking method having excellent operational stability using said wet paper web transfer belt, and a method for producing said wet paper web transfer belt.

BEST MODES FOR CARRYING OUT THE INVENTION

Figure 1:
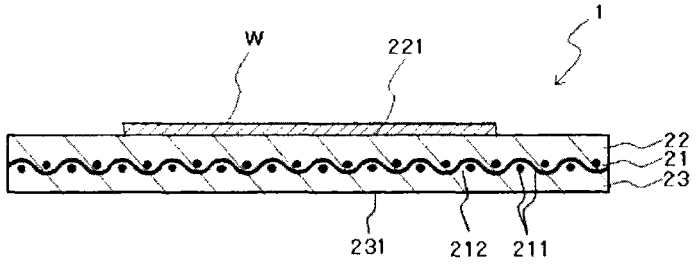
FIG. 1 is a sectional view in the cross machine direction showing one example of a wet paper web transfer belt relating to a preferred embodiment of the present invention.

Hereinafter, preferred embodiments of the wet paper web transfer belt, the method for producing a wet paper web transfer belt, the papermaking system, and the papermaking method according to the present invention will be explained in detail by referring to the drawings.

Firstly, the wet paper web transfer belt according to the present invention will be explained.

Figure 2:
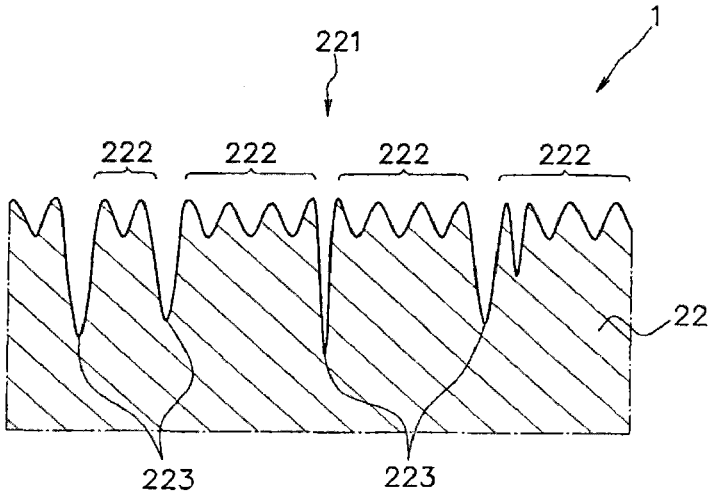
FIG. 2 is a schematic enlarged sectional view in the cross machine direction showing one example of a wet paper web carrying surface comprised in the wet paper web transfer belt shown in FIG. 1.

FIG. 1 is a sectional view in the cross machine direction showing one example of a wet paper web transfer belt relating to a preferred embodiment of the present invention; FIG. 2 is a schematic enlarged sectional view in the cross machine direction showing one example of a wet paper web carrying surface comprised in the wet paper web transfer belt shown in FIG. 1. It should be noted that, in FIG. 1, a wet paper web W to be transferred is shown to facilitate understanding; however, it goes without saying that this is not the constitution of wet paper web transfer belt 1. Moreover, in the drawings, each member is suitably emphasized to facilitate explanation and their size and proportion do not correspond to the real members. Furthermore, hereinafter, the planned machine direction in the papermaking system will be referred to as "MD" and the planned cross machine direction in the papermaking system will be referred to as "CMD".

The wet paper web transfer belt 1 shown in FIGS. 1 and 2 is used for transferring and passing the wet paper web W in the press part of a papermaking machine. The wet paper web transfer belt 1 forms an endless band-shaped body. In other words, the wet paper web transfer belt 1 is an annular belt. Then, the longitudinal direction of the wet paper web transfer belt 1 is generally disposed along the machine direction (MD) of a papermaking system.

The wet paper web transfer belt 1 comprises a reinforcing fiber base material layer 21, a $1^{st}$ resin layer (wet paper web carrying resin layer) 22 provided on one main surface at the outer surface side of the reinforcing fiber base material layer 21, and a $2^{nd}$ resin layer (roll side layer) 23 provided on the other surface of the reinforcing fiber base material layer 21; these layers are formed by laminating. Moreover, the $1^{st}$ resin layer is the layer that forms the outer surface (outer circumferential face) of the annular shape forming the wet paper web transfer belt 1.

The reinforcing fiber base material layer 21 is made of a reinforcing fiber base material 211 and a resin 212. The resin 212 is present in the reinforcing fiber base material layer 21 so as to fill the gaps of the fibers in the reinforcing fiber base material 211. In other words, one part of the resin 212 impregnates the reinforcing fiber base material 211 while the reinforcing fiber base material 211 is embedded in the resin 212.

There are no particular limitations with regard to the reinforcing fiber base material 211; however, for example, fabrics woven by a weaving machine and the like from warp and weft yarns are commonly used. Moreover, it is also possible to use a grid-like web material of superimposed rows of warp and weft yarns without weaving.

The fineness of the fibers constituting the reinforcing fiber base material 211 is not particularly limited, for example, 300 to 10000 dtex, and preferably 500 to 6000 dtex may be used.

Moreover, the fineness of the fibers constituting the reinforcing fiber base material 211 may be different depending on the part in which the fibers are used. For example, the fineness of the warp and weft yarns in the reinforcing fiber base material 211 may be different.

As reinforcing fiber base material 211, it is possible to use one or a combination of two or more polyesters (polyethylene terephthalate, polybutylene terephthalate, and the like), aliphatic polyamides (polyamide 6, polyamide 11, polyamide 12, polyamide 612, and the like), aromatic polyamides (aramid), polyvinylidene fluoride, polypropylene, polyether ether ketone, polytetrafluoroethylene, polyethylene, wool, cotton, metals, and the like.

As resin 212, it is possible to use one or a combination of two or more of thermosetting resins such as urethane, epoxy, acryl, and the like, or thermoplastic resins such as polyamide, polyarylate, polyester, and the like; preferably, urethane resin may be used.

The urethane resin used in the resin 212 is not particularly limited; however, for example, urethane resin obtained by curing a urethane prepolymer having a terminal isocyanate group, which was obtained by reacting an aromatic or aliphatic polyisocyanate compound and polyol, together with a curing agent having an active hydrogen group may be used. Moreover, it is possible to use an anionic, nonionic or cationic aqueous urethane resin of the self-emulsification type or forced emulsification type. In this case, for improving the resistance to water, it is also possible to crosslink the aqueous urethane resin by using a cross linking agent of melamine, epoxy, isocyanate, carbodiimide, and the like, together with the aqueous urethane resin.

In addition, the resin 212 may also comprise one type or a combination of two or more types of inorganic fillers such as titanium oxide, kaolin, clay, talc, diatomaceous earth, calcium carbonate, calcium silicate, magnesium silicate, silica, mica, and the like.

Further, the type and composition of the resin 212 in the reinforcing fiber base material layer 21 may be different in each part of the reinforcing fiber base material layer 21 or it may be the same.

The 1$^{st}$ resin layer 22 is provided on one main surface of the reinforcing fiber base material layer 21 and is mainly made of a resin material.

The 1$^{st}$ resin layer 22 constitutes a wet paper web carrying surface 221, which is in contact with the wet paper web W and carries the wet paper web W on the main surface at the opposite side of the main surface that is joined to the reinforcing fiber base material layer 21. In other words, the wet paper web transfer belt 1 carries the wet paper web W on the wet paper web carrying surface 221 of the 1$^{st}$ resin layer 22 and can transfer the wet paper web W.

The skewness Rsk of the roughness curve of the wet paper web carrying surface 221 is −0.5 or less.

Here, the roughness curve of the skewness Rsk is the parameter defined according to JIS B0601:2001 (or the corresponding ISO 4287:1997). Rsk can express the degree of asymmetry of the height distribution in relation to the mean line of the roughness curve. If Rsk=0, it means that the height distribution of the roughness curve is symmetrical in relation to the mean line of the roughness curve; if Rsk<0, it means that the height distribution of the roughness curve tends towards the upper side of the mean line; and if Rsk>0, it means that the height distribution of the roughness curve tends towards the lower side of the mean line. Since the height distribution of the roughness curve tends towards the upper side of the mean line when Rsk<0, the region of the convex portions protruding from the mean line is wide, while the region of the concave portions recessed from the mean line is narrow. Moreover, the depth of the convex portions is greater than the height of the concave portions of the wide region.

FIG. 2 is a schematic enlarged sectional view in the cross machine direction showing one example of the wet paper web carrying surface 221 of the wet paper web transfer belt 1. FIG. 2 shows, as an example, the schematic view of a case in which Rsk is −2.7 and the arithmetic average surface roughness Ra is 12.0. As shown in FIG. 2, since Rsk is negative and sufficiently small, the convex portions 222, which are higher than the mean line, account for a relatively flat and wide region, wherein the web paper web W can adhere to the convex portions 222. On the other hand, the concave portions 223, which are deeper than the mean line, form holes of a relatively large volume as relatively steep valleys. When the wet paper web W is released, such concave portions 223 are advantageous for rupturing the water film between the wet paper web W and the wet paper web carrying surface 221 and for introducing air between the wet paper web W and the wet paper web carrying surface 221 and contribute to the improvement of the release properties of the wet paper web W from the wet paper web carrying surface 221.

Then, if Rsk is −0.5 or less, the convex portions 222 contributing to the improvement of the adhesive properties of the wet paper web W with the wet paper web carrying surface 221 and the concave portions 223 contributing to the improvement of the release properties of the wet paper web W from the wet paper web carrying surface 221 are thus disposed on the wet paper web carrying surface 221 in an appropriate ratio, and the wet paper web transfer belt 1 at the same time excels in the adhesive and release properties of the wet paper web W, which were conflicting properties in conventional belts. The result thereof is that the wet paper web transfer belt 1 has excellent wet paper web transfer properties wherein the paper robbing phenomenon is prevented when the wet paper web W is passed in the press part.

Thus, Rsk may be −0.5 or less; however, −2.7 to −0.5 is preferred, −2.5 to −0.8 is even more preferred, and −2.3 to −1.1 is still more preferred.

Due to this, the excellent adhesive and release properties of the wet paper web W described in relation to the wet paper web transfer belt 1 can be more reliably established.

Furthermore, it is preferred that 50% or more of the area of the wet paper web carrying surface 221 are within the above-mentioned Rsk ranges, even more preferred are 80% or more, still more preferred are 90% or more.

Moreover, the arithmetic average roughness Ra of the wet paper web carrying surface 221 is not particularly limited; however, it is preferably between 1.0 and 20 μm, 2.0 to 12.0 μm are even more preferred, and 2.5 to 9.0 μm are still more preferred. Due to this, the excellent adhesive and release properties of the wet paper web W described in relation to the wet paper web transfer belt 1 can be more reliably established.

Furthermore, the term average roughness Ra as it is used in the present specification is defined according to JIS B0601.

Moreover, it is possible to measure the above-mentioned Rsk and Ra for any curved surface and line of the wet paper web carrying surface 221; however, in case polishing marks are formed on the wet paper web carrying surface 221, measuring preferably perpendicular to the direction of the polishing marks is also possible so as to perform measurement in the transverse direction of the polishing marks.

As resin material constituting the 1$^{st}$ resin layer 22, it is possible to use one type or a combination of two or more types of the resin materials that can be used in the reinforcing fiber base material layer 21, as described above. The type and composition of the resin material constituting the 1st resin layer 22 and the resin constituting the reinforcing fiber base material layer 21 may be the same or may be different.

From the point of view of mechanical strength, wear resistance and flexibility, in particular urethane resins are preferred as resin material constituting the 1st resin layer 22.

Moreover, the 1st resin layer 22 may also comprise one or more inorganic fillers in the same way as the reinforcing fiber base material layer 21.

Further, the type and composition of the resin materials and the inorganic fillers in the 1st resin layer 22 may be different in each part of the 1st resin layer or it may be the same.

Moreover, the 1st resin layer 22 preferably has the property of not letting water pass. In other words, the 1st resin layer 22 is preferably water-impermeable.

The 2nd resin layer (roll side layer) 23 is provided on one main surface of the reinforcing fiber base material layer 21 and is mainly made of a resin material.

The 2nd resin layer 23 constitutes a roll contacting surface 231 for contacting a roll, described hereinafter, on the main surface at the opposite side of the main surface that is joined to the reinforcing fiber base material layer 21. For transferring the wet paper web, the wet paper web transfer belt 1 can be driven during use via a roll by bringing the roll contacting surface 231 in contact with the roll.

As resin material constituting the 2nd resin layer 23, it is possible to use one type or a combination of two or more types of the resin materials that can be used in the reinforcing fiber base material layer 21, as described above. The type and composition of the resin material constituting the 2nd resin layer 23 and the resin material constituting the 1st resin layer 22 or the reinforcing fiber base material layer 21 may be the same or may be different.

From the point of view of mechanical strength, wear resistance and flexibility, in particular urethane resins are preferred as resin material constituting the 2nd resin layer 23.

Moreover, the 2nd resin layer 23 may also comprise one or more inorganic fillers in the same way as the reinforcing fiber base material layer 21.

Further, the type and composition of the resin materials and the inorganic fillers in the 2nd resin layer 23 may be different in each part of the 2nd resin layer or it may be the same.

The dimensions of the wet paper web transfer belt 1 described above are not particularly limited, as they may be suitably set according to the use of the wet paper web transfer belt.

The width of the wet paper web transfer belt 1 is not particularly limited, however, it may, for example, be 700 to 13,500 mm, or preferably 2,500 to 12,500 mm.

Further, the length (circumferential length) of the wet paper web transfer belt 1 is not particularly limited, however, it may, for example, be 4 to 35 m, or preferably 10 to 30 m.

Moreover, the thickness of the wet paper web transfer belt 1 is not particularly limited, however, it may, for example, be 1.5 to 7.0 mm, or preferably 2.0 to 6.0 mm.

Further, the wet paper web transfer belt 1 may have a different thickness in each place or it may have the same thickness everywhere.

A wet paper web transfer belt 1 as described above may be produced by the method for producing a wet paper web transfer belt according to the present invention described hereinafter.

The wet paper web transfer belt 1 according to the above embodiment has excellent wet paper web transfer properties, wherein excellent adhesive and release properties of the wet paper web W are obtained because the wet paper web carrying surface 221 has a predetermined Rsk, and the paper robbing phenomenon is prevented when the wet paper web W is passed in the press part. In particular, the excellent adhesive and release properties of the wet paper web W in relation to the wet paper web transfer belt 1 are more reliably established because the arithmetic average roughness of the wet paper web carrying surface 221 is within the range described above.

As a modified embodiment of the wet paper web transfer belt 1 described above, an embodiment can, for example, be mentioned in which the roll side layer is not a layer constituted by a resin material, but by a batt fiber layer formed by needling batt fiber. Further, as still another modified embodiment of the wet paper web transfer belt according to the present invention, an embodiment can, for example, be mentioned which comprises a layer in which the above-mentioned batt fibers are impregnated by resins such as those mentioned above. In either of these modified embodiments, except for the roll side layer, the same constitution as in the above-mentioned wet paper web transfer belt 1 may be adopted.

Moreover, as material of the batt fibers, it is possible to use one or a combination of two or more of the materials that can be used in the reinforcing fiber base material 211.

Furthermore, in the embodiments described above, it is explained that the wet paper web carrying surface 221 in the wet paper web transfer belt 1 is provided on the outer circumferential surface of the 1st resin layer 22; however, the invention is not limited thereto; it is also possible that only the region destined to carry the wet paper web as wet paper web carrying surface has the predetermined skewness Rsk.

Moreover, a tab or the like may be provided in a suitable wet paper web transfer belt to match the constitution of the papermaking machine that is being used.

Figure 3A:
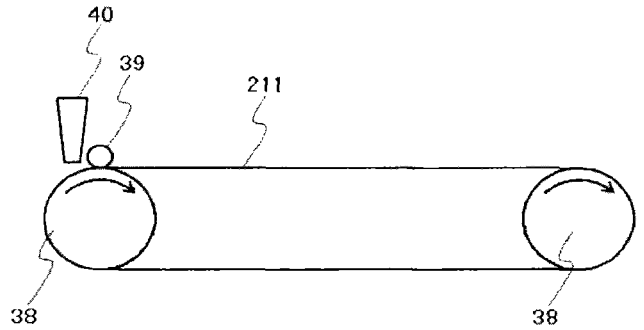
FIGS. 3(A) and 3(B) are schematic diagrams explaining a preferred embodiment of a method for producing a wet paper web transfer belt according to the present invention.
Figure 3B:
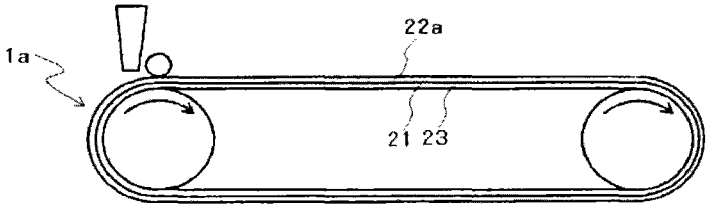
Figure 4:
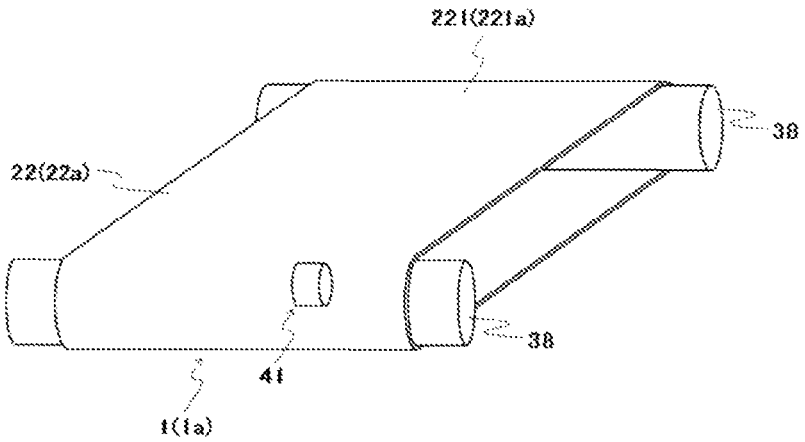
FIG. 4 is a schematic diagram explaining a preferred embodiment of a method for producing a wet paper web transfer belt according to the present invention.

Next, a preferred embodiment of a method for producing a wet paper web transfer belt according to the present invention will be explained. FIGS. 3(A) and 3(B) are schematic diagrams explaining a preferred embodiment of a method for producing a wet paper web transfer belt according to the present invention, and FIG. 4 is a schematic diagram explaining a preferred embodiment of a method for producing a wet paper web transfer belt according to the present invention.

The method for producing the wet paper web transfer belt relating to the 1st embodiment of the present invention is a method for producing a wet paper web transfer belt for transferring a wet paper web; wherein it comprises a resin layer forming step of forming a resin layer, a 1st polishing step of polishing the surface of said resin layer using an abrasive having a grit of #120 or less, and a 2nd polishing step of polishing said surface using an abrasive having a grit of #240 or more.

First, the resin layer is formed in the resin layer forming step. In this step, specifically, a laminated body 1*a* is formed in which a reinforcing fiber base material layer 21 in which an annular and band-shaped reinforcing fiber base material 211 is embedded in a resin material, and on both sides thereof, a 1st resin layer precursor 22*a* as resin layer and a 2nd resin layer 23 are laminated.

Such a laminated body 1*a* may be formed by any method; however, in the present embodiment, the reinforcing fiber base material layer 21 is formed by coating a resin material onto the reinforcing fiber base material 211 so that the resin material penetrates the reinforcing fiber base material 211, and at the same time, the 1st resin layer precursor 22*a* and the 2nd resin layer 23 are formed on both sides of the reinforcing fiber base material layer 21.

Specifically, first, as shown in FIG. 3(A), the annular and band-shaped reinforcing substrate 211 is installed so as to be in contact with two rolls 38 which are disposed in parallel.

Next, as shown in FIG. 3(B), a resin material is applied to the outer surface of the reinforcing fiber base material 221. The resin material may be applied by any method; however, in the present embodiment, the resin material is applied to the reinforcing fiber base material 211 by discharging the resin material from the resin discharge opening 40 while rotating the rolls 38. Moreover, at the same time, the applied resin material is uniformly coated onto the reinforcing fiber base material 211 by using a coating bar 39. The resin material coated at this time can penetrate the reinforcing fiber base material 211. Therefore, in the present embodiment, it is possible to apply the resin comprised in the reinforcing fiber base material 211 and, at the same time, the resin material constituting the 1st resin layer precursor 22*a* and the 2nd resin layer 23.

Moreover, the resin material may also be applied as a mixture with the above-mentioned inorganic filler. Further, the type and composition of the resin material and the inorganic filler for forming the layers may be different or may be the same for each layer.

Next, the coated resin material is cured. By this means, the laminated body 1 *a*, in which the layers are laminated from the outer surface in the order of the 1st resin layer precursor 22*a*, the reinforcing fiber base material layer 21 and the 2nd resin layer 23, is obtained. The method for curing the resin material is not particularly limited; however, the curing may, for example, be performed by heating, UV irradiation, and the like.

Moreover, in case the resin material is cured by heating, for example, a far infrared heater or other method may be used.

Further, in case the resin material is cured by heating, the heating temperature of the resin material is preferably 60 to 150° C., and still more preferably 90 to 140° C. Furthermore, the heating time can, for example, be 2 to 24 hours, and preferably 3 to 20 hours.

Next, in the 1st polishing step, the surface of the resin layer is polished by using an abrasive having a grit of #120 or less. Specifically, the outer surface of the 1st resin layer precursor 22*a* is polished by the above-mentioned abrasive as the resin layer that is to become the wet paper web carrying surface 221. Thus, by polishing the surface of the resin layer with a relatively coarse abrasive, it is possible to form relatively great unevenness on the surface of the resin layer.

The grit of the abrasive may be #120 or less, as described above; however, #100 or less is preferred, and #40 to #80 is even more preferred. By this means, it is possible to more reliably adjust the skewness Rsk of the roughness curve of the wet paper web carrying surface 221 that is to be formed in the end.

The abrasive used may be abrasive particles in the form of powder or slurry; however, coated abrasive cloth or paper to which the abrasive particles have been attached is preferable.

Specifically, this step is performed by bringing a polishing device 41 fitted with an abrasive in contact with the laminated body 1*a* which is installed on the 2 rolls 38, as shown in FIG. 4.

As method of using the polishing device 41, for example, the entire outer surface 221*a* of the 1st resin layer precursor 22*a* is polished. Further, it is preferred that the polishing in this step adjusts the thickness of the 1st resin layer precursor 22*a* to approximately the thickness of the 1st resin layer 22 that is to be obtained in the end. The grit of the abrasive in this step is small; therefore it is possible to efficiently adjust the thickness.

Moreover, it is possible to omit the polishing of the outer surface 221*a* corresponding to the vicinity of the end parts of the 1st resin layer precursor 22*a*. Nevertheless, in consideration of the load from the roll edges, it is preferred to perform the machining so that the thickness at the vicinity of the end parts of the wet paper web transfer belt 1 is thinner than the thickness in other parts.

Moreover, in this step, a plurality of polishing processes using abrasives of a grit within the ranges described above may also be performed. In this case, abrasives of different grit may also be used for each polishing process.

Next, in the 2nd polishing step, the surface of the resin layer, in other words, the outer surface 221*a* of the 1st resin layer precursor 22*a*, is polished by using an abrasive having a grit of #240 or more. Thus, by using abrasives of a grit that greatly differs from the abrasive used in the 1st polishing step, relatively flat convex portions are formed by polishing the convex portions of the relatively great unevenness on the outer surface of the 1st resin layer precursor 22*a* formed in the 1st polishing step. By this means, the wet paper web carrying surface 221 having relatively deep concave portions and convex portions which are relatively flat over a wide region, in other words, having the desired skewness Rsk of the roughness curve described above, is formed. By this means, the wet paper web transfer belt 1 is obtained.

The grit of the abrasive may be #240 or more, as mentioned above; however, a grit of #280 or more is preferred and a grit between #320 and #800 is even more preferred. By this means, it is possible to more reliably adjust the skewness Rsk of the roughness curve of the wet paper web carrying surface 221 that is to be formed in the end in the desired range, and, at the same time, to adjust the arithmetic average roughness Ra in the preferred range.

Moreover, the difference of the abrasive grit used in the 1st polishing step and the abrasive grit used in the 2nd polishing step is not particularly limited; however, it is preferably #180 or more and even more preferably #240 or more. By this means, it is possible to more reliably form relatively deep and narrow concave portions and relatively flat convex portions over a wide region on the outer surface 221*a* (wet paper web carrying surface 221) and to more reliably adjust the skewness Rsk of the roughness curve of the wet paper web carrying surface 221 that is to be formed in the end in the desired range.

The abrasive used may be abrasive particles in the form of powder or slurry; however, coated abrasive cloth or paper to which the abrasive particles have been attached is preferable.

Specifically, this step is performed by bringing a polishing device 41 fitted with an abrasive into contact with the laminated body 1*a* which is installed on the 2 rolls 38, in the same way as in the 1st polishing step.

Moreover, the places polished in this step are places corresponding to the wet paper web carrying surface 221 that is to be formed and comprise at least the parts polished in the 1st polishing step.

Moreover, in this step, a plurality of polishing processes using abrasives of a grit within the ranges described above may also be performed. In this case, abrasives of different grit may also be used for each polishing process.

Furthermore, it is preferred to perform this step after the $1^{st}$ polishing step without performing other polishing or buffing operations of places corresponding to the wet paper web carrying surface 221 to be formed. In other words, it is preferred to consecutively perform the $1^{st}$ and the $2^{nd}$ polishing steps.

Moreover, as a modified embodiment of the method for producing a wet paper web transfer belt 1 described above, there is an embodiment in which, instead of the reinforcing fiber base material 211 described above, a reinforcing fiber base material in which batt fibers have been needled is used. By this means, the above-mentioned wet paper web transfer belt having, as roll side layer, a batt fiber layer, or the wet paper web transfer belt comprising a roll side layer in which the batt fibers have been impregnated by resin can be obtained.

Next, a method for producing the wet paper web transfer belt relating to the $2^{nd}$ embodiment according to the present invention will be explained.

The method for producing the wet paper web transfer belt according to this embodiment is a method for producing a wet paper web transfer belt for transferring a wet paper web; wherein it comprises a step of forming a resin layer, and a step of polishing the surface of the resin layer in two stages successively using a $1^{st}$ abrasive and a $2^{nd}$ abrasive of a finer grit than the $1^{st}$ abrasive, to form a wet paper web carrying surface for carrying a wet paper web.

The step for forming the resin layer may be performed in the same way as the resin layer forming step of the $1^{st}$ embodiment described above.

In the next step, the surface of the resin layer is polished in two stages by successively using a $1^{st}$ abrasive and a $2^{nd}$ abrasive of a finer grit than the $1^{st}$ abrasive, and a wet paper web carrying surface for carrying a wet paper web is formed. By this means, the wet paper web carrying surface is formed on the resin layer ($1^{st}$ resin layer) and a wet paper web transfer belt is obtained.

In the polishing step for forming a wet paper web carrying surface in the prior art, in general, 4 or more types of abrasive having different grits are used with the aim of uniformly polishing the surface, and the polishing is performed in stages according to the number of types of abrasives. In contrast, in the present embodiment, by polishing the surface of the resin layer in only two stages by intentionally using 2 types of abrasive, it is possible to increase the asymmetry of the heights of the wet paper web carrying surface formed and to reduce the skewness Rsk of the roughness curve of the wet paper web carrying surface.

Moreover, as long as the relationship of the grits described above is satisfied, the $1^{st}$ abrasive and the $2^{nd}$ abrasive are not particularly limited. Nevertheless, it is preferred that the $1^{st}$ abrasive and the $2^{nd}$ abrasive, respectively, have a grit corresponding to the abrasive used in the $1^{st}$ embodiment, described above, for the abrasive used in the $1^{st}$ polishing step and the abrasive used in the $2^{nd}$ polishing step. By this means, it is possible to more reliably adjust the skewness Rsk of the roughness curve of the wet paper web carrying surface that is to be formed in the end in the desired range, and, at the same time, to adjust the arithmetic average roughness Ra in the preferred range.

Moreover, the specific polishing methods in this step may be the same as the $1^{st}$ polishing step and the $2^{nd}$ polishing step in the $1^{st}$ embodiment described above.

Next, a method for producing the wet paper web transfer belt relating to the $3^{rd}$ embodiment according to the present invention will be explained.

The method for producing a wet paper web transfer belt according to the present embodiment is a method for producing a wet paper web transfer belt for transferring a wet paper web; wherein it comprises a resin layer forming step of forming a resin layer, a $1^{st}$ polishing step of polishing the surface of said resin layer using a $1^{st}$ abrasive, and a $2^{nd}$ polishing step of polishing said surface using a $2^{nd}$ abrasive of a finer grit than the $1^{st}$ abrasive; wherein the $1^{st}$ polishing step and the $2^{nd}$ polishing step are performed consecutively, and the difference between the grit of the abrasive used in the $1^{st}$ polishing step and the grit of the abrasive used in the $2^{nd}$ polishing step is #120 or more.

The resin forming step may be performed in the same way as the resin forming step in the $1^{st}$ embodiment described above.

Next, in the $1^{st}$ polishing step, the surface of the above-mentioned resin layer is polished by using a $1^{st}$ abrasive. The specific polishing method in this step may be the same as the $1^{st}$ polishing step in the $1^{st}$ embodiment described above.

The grit of the $1^{st}$ abrasive used in this step is not particularly limited; however, preferably, it may be the same as the grit of the abrasive used in the $1^{st}$ polishing step of the $1^{st}$ embodiment.

Next, in the $2^{nd}$ polishing step, the surface of the resin layer is polished by using a $2^{nd}$ abrasive of a finer grit than the $1^{st}$ abrasive. By this means, the wet paper web carrying surface is formed on the resin layer ($1^{st}$ resin layer) and a wet paper web transfer belt is obtained.

Moreover, this step, in other words the $2^{nd}$ polishing step, is performed consecutively to the $1^{st}$ polishing step, and the difference between the grit of the abrasive used in the $1^{st}$ polishing step and the grit of the abrasive used in the $2^{nd}$ polishing step is #120 or more. Thus, in contrast to conventional methods in which the grit of the abrasives is finely set in stages, in the present embodiment, the difference of the grit of the $1^{st}$ abrasive and $2^{nd}$ abrasive is intentionally set at a relatively large value, and by performing these polishing steps consecutively, it is possible to increase the asymmetry of the heights of the wet paper web carrying surface formed and to reduce the skewness Rsk of the roughness curve of the wet paper web carrying surface.

Moreover, the difference of the abrasive grit used in the $1^{st}$ polishing step and the abrasive grit used in the $2^{nd}$ polishing step may be within the range described above; however, it is preferably #180 or more and even more preferably #240 or more. By this means, it is possible to more reliably form relatively deep and narrow concave portions and relatively flat convex portions over a wide region on the outer surface and to more reliably adjust the skewness Rsk of the roughness curve of the wet paper web carrying surface that is to be formed in the end in the desired range.

The grit of the $2^{nd}$ abrasive used in this step is not particularly limited; however, preferably, it may be the same as the grit of the abrasive used in the $1^{st}$ polishing step of the $2^{nd}$ embodiment.

Moreover, the specific polishing methods in this step may be the same as the $2^{nd}$ polishing step in the $1^{st}$ embodiment described above.

Figure 5:
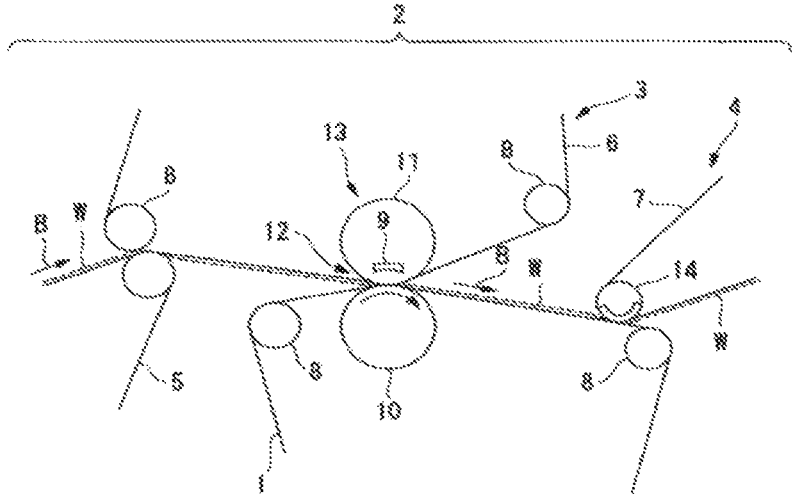
FIG. 5 is a schematic diagram showing one example of one part of the press part in a preferred embodiment of a papermaking system according to the present invention.

Next, a papermaking system according to the present invention will be explained by referring to the preferred embodiments. FIG. 5 is a schematic diagram showing one example of one part of the press part in a preferred embodiment of a papermaking system according to the present invention.

The papermaking system according to the present invention comprises a press part squeezing moisture from a wet paper web; wherein the press part is configured so that, in at least one part thereof, a wet paper web transfer belt according to the present invention is used in a closed draw so as to pass a wet paper web.

Moreover, in the present embodiment, the papermaking system 2 comprises a wire part (not shown in the drawing) forming a wet paper web by dewatering a pulp slurry, a press part 3 squeezing moisture from the wet paper web, and a dryer part 4 drying the wet paper web from which moisture has been squeezed. These parts are arranged in the order of wire part, press part 3 and dryer part 4 in the wet paper web W transfer direction (the direction of arrow B) in the order of the steps performed by these parts.

The wire part is configured to dewater the pulp slurry supplied from a head box while it is carried and transferred so as to form a wet paper web. The wet paper web formed is transferred to the press part 3. In the present embodiment, the constitution of a publicly known wire part can be used; therefore, the detailed description is omitted.

Next, the press part 3 is configured so as to squeeze moisture from the wet paper web transferred from the wire part. In general, press parts are publicly known, and, in the present embodiment, a publicly known constitution can be used for certain parts of the press part 3; therefore, the detailed description of the publicly known parts of the constitution of press part 3 is omitted.

The press part 3 comprises a press felt (also simply referred to as felt) 5, a press felt 6, a wet paper web transfer belt 1, guide rollers 8 for guiding and rotating the press felts 5, 6 and the wet paper web transfer belt 1, and a press section 12. The press felt 5, the press felt 6 and the wet paper web transfer belt 1 are each a band-shaped body configured to form an endless shape and are supported by the guide rollers 8. The press felts 5, 6, the wet paper web transfer belt 1 and a dryer fabric 7, respectively, support and transfer the wet paper web W in the direction of the arrow B. At this juncture, the wet paper web W is passed from the press felt 5 to the press felt 6 and from the press felt 6 to the wet paper web transfer belt 1.

The wet paper web W is passed through the press section 12 in a closed draw from the press felt 6 to the wet paper web transfer belt 1.

Hereinafter the press section 12 will be described. The press section 12 is a compression means constituted by a shoe press mechanism 13 and a press roll 10 arranged in a position facing the shoe press mechanism. The shoe press mechanism 13 comprises a concave shoe 9 facing the press roll 10 and a band-shaped shoe press belt 11 surrounding the shoe 9. Together with the press roll 10, the shoe 9 constitutes the press section 12 via the shoe press belt 11. In the press section 12, the wet paper web W is pressed by the shoe 9 via the shoe press belt 11 and the press roll 10 while being sandwiched between the press felt 6 and the wet paper web transfer belt 1. As a result thereof, moisture is squeezed from the wet paper web W. The press felt 6 is configured to have high water permeability, and the wet paper web transfer belt 1 is configured to have low water permeability. Therefore, in the press section 12, the moisture in the wet paper web W moves to the press felt 6. In this way, in the press part 3, water is squeezed from the wet paper web W and the surface of the wet paper web is smoothed.

Immediately after exiting the press section 12, the wet paper web W, the press felt 6, and the wet paper web transfer belt 1 swell in volume because they are suddenly released from pressure. Due to this swelling and because of the capillary action of the pulp fibers constituting the wet paper web W, the so-called "rewetting phenomenon" occurs in which part of the moisture in the press felt 6 moves to the wet paper web W. Nevertheless, since the water permeability of the wet paper web transfer belt 1 is low, the amount of moisture held inside it is small. Therefore, there is hardly any rewetting due to moisture moving from the wet paper web transfer belt 1 to the wet paper web W, and the wet paper web transfer belt 1 contributes to improving the smoothness of the wet paper web W.

For passing the wet paper web W in the press section 12 in such a manner, it is required of the wet paper web transfer belt 1 that, immediately after exiting the press section 12, the wet paper web W is released from the press felt 6 and positively adheres to the wet paper web carrying surface 221 of the wet paper web transfer belt 1. In general, it is in such places that the "paper robbing" phenomenon tends to occur. The "paper robbing" described here indicates a phenomenon, in case a common wet paper web transfer belt is used, in which the adhesive force of the wet paper web carrying surface is weak and the wet paper web passing the press section remains on the press felt without being moved from the press felt to the wet paper web transfer belt. Nevertheless, in the wet paper web transfer belt 1, which has a suitable degree of adhesiveness of the wet paper web carrying surface 221 with the wet paper web W, as described above, the paper robbing phenomenon by the press felt 6 is prevented because it has excellent wet paper web transfer properties.

Moreover, the wet paper web W, having passed the press section 12, is carried and transferred by the wet paper web transfer belt 1 and is passed in a closed draw from the wet paper web transfer belt 1 to the dryer fabric 7 of the dryer part 4. The suction roll 14 of the dryer part 4, provided to support the dryer fabric 7, releases the wet paper web W adhering to the wet paper web transfer belt 1 by suction and causes it to adhere to the surface of the dryer fabric 7. The wet paper web transfer belt 1 has suitable properties for releasing the wet paper web W from the wet paper web carrying surface 221; therefore, in this case too, the "paper robbing" phenomenon is prevented when the wet paper web is passed.

The dryer part 4 is configured to dry the wet paper web W. In the present embodiment, a publicly known constitution can be used as dryer part 4; therefore, the detailed description is omitted. The wet paper web W is dried and becomes base paper by passing through the dryer part 4.

Thus, according to the papermaking system of the present invention, by using a wet paper web transfer belt with excellent wet paper web transfer properties, it is possible to suppress the paper robbing phenomenon and to improve production stability.

Next, a papermaking method according to the present invention will be described by referring to a preferred embodiment.

The papermaking method according to the present invention comprises a step of squeezing moisture from a wet paper web formed by dewatering a pulp slurry; in this step, the wet paper web is passed in a closed draw by using a wet paper web transfer belt according to the present invention.

Moreover, the papermaking method according to the present embodiment comprises a step of forming a wet paper web by dewatering a pulp slurry (dewatering step), a step of squeezing moisture from the wet paper web (moisture squeezing step), and a step of drying the wet paper web (drying step).

Further, the dewatering step and the drying step can each be performed by a publicly known method; therefore, the detailed description will be omitted. For example, the dewatering step and the drying step can be performed by using the above-mentioned wire part and dryer part 4, respectively.

In the water squeezing step, water is further squeezed from the wet paper web obtained in the dewatering step.

In the present embodiment, in the water squeezing step, the wet paper web is passed in a closed draw by using the above-described wet paper web transfer belt according to the present invention. By using a wet paper web transfer belt according to the present invention having excellent wet paper web transfer properties, the paper robbing phenomena are prevented.

In particular, it is preferred to move the wet paper web in a closed draw from a felt to the wet paper web transfer belt. In this case, problems such as the above-mentioned paper robbing phenomenon are more reliably prevented.

Moreover, the moisture squeezing step may be performed by using the press part 3 described above.

Thus, according to the papermaking method of the present invention, by using a wet paper web transfer belt with excellent wet paper web transfer properties, it is possible to suppress the paper robbing phenomenon and to improve production stability.

Above, the present invention has been described in detail based on preferred embodiments; however, the present invention is not limited by this. Each constitution may be substituted as desired, or a constitution may be added as desired, as long as a similar function can be obtained.

EXAMPLES

Hereinafter, the present invention will be described even more specifically by means of the Examples; however, the present application is not limited to these Examples.

1. Production of the Wet Paper Web Transfer Belt

The wet paper web transfer belts of Examples 1 to 9 and Comparative Examples 1 to 3 were produced according to the method hereinafter.

(1) Resin Layer Forming Step

Firstly, the reinforcing fiber base material of the constitution hereinafter was prepared.

The Reinforcing Fiber Base Material

Upper warp yarn: twisted monofilament of 2000 dtex made from nylon 6

Lower warp yarn: twisted monofilament of 2000 dtex made from nylon 6

Weft yarn: twisted monofilament of 1400 dtex made from nylon 6

Weave: double warp weave of 40 upper/lower warp yarns/5 cm and 40 weft yarns/5 cm The reinforcing fiber base material was made by entangling and integrating batt fibers of 20 dtex made from nylon 6 with the woven fabric of the above constitution by needling 200 g/m$^2$ of the batt fibers to the roll side of the woven fabric.

Next, as shown in FIG. 3(A), the reinforcing fiber base material was installed on 2 rolls so that the batt fiber side is disposed at the inner side.

Next, as shown in FIG. 3(B), urethane resin was coated so as to form a resin layer of 1.1 to 1.2 mm thickness from the surface of the reinforcing fiber base material by impregnating so that the liquid urethane resin penetrated the fabric of the reinforcing fiber base material from its wet paper web carrying surface side.

Next, the coated resin was cured and the semi-finished product of a wet paper web transfer belt was obtained, wherein a reinforcing fiber base material layer in which the reinforcing fiber base material is impregnated by urethane resin, a 1$^{st}$ resin layer precursor formed at the outer circumference of the reinforcing fiber base material layer, and a 2$^{nd}$ resin layer formed at the inner circumference of the reinforcing fiber base material layer are laminated.

(2) Polishing Step

The outer circumferential surface of the obtained semi-finished product of the 1$^{st}$ resin layer precursor was polished as shown in FIG. 4.

As polishing, rough grinding (1$^{st}$ polishing step), adjusting the thickness of the resin layer precursor to about 1.0 mm by using a relatively coarse abrasive, and finishing (2$^{nd}$ polishing step), adjusting the roughness of the wet paper web carrying surface to be formed in the end, were performed.

In the rough grinding (1$^{st}$ polishing step) and the finishing (2$^{nd}$ polishing step) of the Examples and Comparative Examples, coated abrasives of the grits given in Table 1 were used as abrasive. Moreover, in Examples 1 to 9 and Comparative Examples 2, 3, polishing was performed in two stages by using two types of coated abrasives. In Comparative Example 1, on the other hand, polishing was performed in four stages by using four types of coated abrasives.

By going through the above polishing steps, a wet paper web carrying surface having a predetermined skewness of the roughness curve and arithmetic average roughness was formed and a wet paper web transfer belt with a 1$^{st}$ resin layer having said wet paper web carrying surface was obtained.

The production conditions of the wet paper web transfer belts obtained in the Examples and Comparative Examples are shown in Table 1 together with the skewness of the roughness curve and the arithmetic average roughness. Moreover, the values for the skewness or the roughness curve and the arithmetic average roughness were obtained by measuring in the width direction, in other words perpendicular to the polishing marks, by using a Surftest SJ-210 (manufactured by Mitutoyo Corporation).

TABLE 1

| | Grit of the coated abrasives | | State of the wet paper web carrying surface | |
|---|---|---|---|---|
| | Rough grinding (1$^{st}$ polishing step) | Finishing (2$^{nd}$ polishing step | Rsk | Ra (μm) |
| Example 1 | #120 | #400 | −0.6 | 2.1 |
| Example 2 | #80 | #320 | −0.6 | 6.5 |
| Example 3 | #60 | #240 | −0.6 | 11.5 |
| Example 4 | #100 | #600 | −1.6 | 2.1 |
| Example 5 | #80 | #400 | −1.6 | 6.5 |
| Example 6 | #60 | #320 | −1.6 | 11.5 |
| Example 7 | #100 | #800 | −2.5 | 2.1 |
| Example 8 | #80 | #600 | −2.5 | 6.5 |
| Example 9 | #60 | #400 | −2.5 | 11.5 |
| Comparative Example 1 | #100 #120 | #180 #240 | −0.35 | 2.1 |
| Comparative Example 2 | #120 | #180 | −0.35 | 6.5 |
| Comparative Example 3 | #100 | #100 | −0.35 | 11.5 |

2. Evaluation of the Transfer

Figure 6:
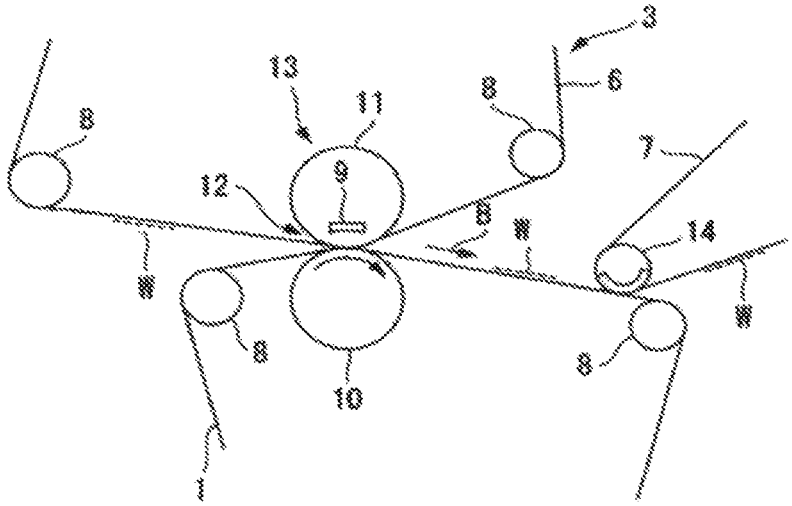
FIG. 6 is a schematic diagram showing an evaluation device of a wet paper web transfer belt.

The evaluation device of wet paper web transfer belts shown in FIG. 6 was used to evaluate the adhesive and release properties between wet paper web W and the wet paper web transfer belt after the wet paper web W had passed the press nip 12 under the conditions hereinafter. Further, the evaluation device shown in FIG. 6 is identical to the device in FIG. 5, except that the constitution upstream of the press felt 6 has been omitted from the constitution of the press part 3. Moreover, the pressing conditions, the constitution of the press felt 6 and the constitution of the wet paper web were as described hereinafter.

The Pressing Conditions

Papermaking speed: 1200 m/min

Pressing pressure: 1050 kN/m

The Constitution of the Press Felt 6

In the press felt 6 used, an intermediate layer batt fiber layer (outer circumferential side) and a rear layer batt fiber layer (inner circumferential side) were formed by needling batt fibers to both sides of a base fabric, and a front layer batt fiber layer was formed by needling batt fibers to the outer circumferential side of the intermediate layer batt fiber layer. Moreover, the constitution and the conditions for forming the batt fiber layers were as described hereinafter. Furthermore, felts with three types of front layer batt fibers of different fineness were provided as press felt 6. The fineness of the front layer batt fibers of the press felts were 3.3 dtex, 6.6 dtex and 11 dtex, respectively.

Base Fabric: Laminated Base Fabric

Upper Fabric Base Fabric

Warp yarn: monofilament of 1400 dtex made from nylon 6

Weft yarn: monofilament of 500 dtex made from nylon 6

Weave: 1/1 plain weave of 50 warp yarns/5 cm and 40 weft yarns/5 cm

Lower Fabric Base Fabric

Warp yarn: twisted monofilament of 2000 dtex made from nylon 6

Weft yarn: twisted monofilament of 1400 dtex made from nylon 6

Weave: 3/1 broken weave of 40 warp yarns/5 cm and 40 weft yarns/5 cm

Batt Fibers Needled to the Base Fabric

Front layer batt fiber: 200 g/m$^2$ batt fiber made from nylon 6

Center layer batt fiber: 300 g/m$^2$ batt fiber of 20 dtex made from nylon 6

Rear layer batt fiber: 100 g/m$^2$ batt fiber of 20 dtex made from nylon 6

Moreover, in the evaluation, the moisture content of the felt 6 was set by using a shower and a suction box (not shown in the drawing).

Felt moisture: felt moisture weight/(felt moisture weight+felt weight per unit area)=adjusted to 30%

Wet Paper Web (Handsheet)

Pulp: LBKP 100% csf 450 mL

Basis weight: 60 g/m$^2$

Wet paper web moisture before pressing: wet paper web moisture weight before pressing/(wet paper web moisture weight before pressing+wet paper web bone dry weight)=adjusted to 60% (moisture control by sandwiching with filter paper)

Wet paper size: 200 mm length by 200 mm width

Under the above conditions, the adhesive property of the wet paper web transfer belts was evaluated by judging whether or not the wet paper web W adhered to the wet paper web transfer belt after the wet paper web W had passed the press nip 12. Moreover, the adhesive property of the wet paper transfer belts was evaluated by using press felts 6 with a front layer batt fiber of different fineness according to the criteria for evaluation hereinafter. Furthermore, the evaluation of the adhesive property of the wet paper web transfer belts was performed immediately after installing the wet paper web transfer belt and after the evaluation device had been operated for three days while water was being supplied.

A: The wet paper web W adhered to the wet paper web transfer belt in the case of all front layer batt fibers of different fineness.

B: The wet paper web W adhered to the wet paper web transfer belt in the case of front layer batt fibers of 6.6 dtex and 11 dtex, while it did not adhere to the wet paper web transfer belt with front layer batt fibers of 3.3 dtex.

C: The wet paper web W adhered to the wet paper web transfer belt in the case of front layer batt fibers of 11 dtex, while it did not adhere to the wet paper web transfer belt with front layer batt fibers of 3.3 dtex and 6.6 dtex.

D: The wet paper web W did not adhere to the wet paper web transfer belt in the case of each of the front layer batt fibers of different fineness.

Moreover, the wet paper web transfer belts with the evaluation A to C above can be considered to have excellent adhesive property.

The release property of the wet paper web transfer belts was evaluated by judging whether or not the wet paper web W carried by the wet paper web transfer belt moved to the dryer fabric 7. Moreover, the evaluation was performed by confirming whether or not the wet paper web W had moved to the dryer fabric 7 while the degree of vacuum in the suction roll 14 was changed to −20 kPa, −30 kPa, −40 kPa, respectively. Furthermore, the evaluation of the release property of the wet paper web transfer belts was performed immediately after installing the wet paper web transfer belt and after the evaluation device had been operated for three days while water was being supplied.

A: The wet paper web W moved to the dryer fabric in the case of every degree of vacuum in the suction roll 14.

B: The wet paper web W moved to the dryer fabric in the case of −30 kPa, −40 kPa vacuum in the suction roll 14, while it did not move to the dryer fabric in the case of −20 kPa vacuum in the suction roll 14.

C: The wet paper web W moved to the dryer fabric in the case of −40 kPa vacuum in the suction roll 14, while it did not move to the dryer fabric in the case of −20 kPa, −30 kPa vacuum in the suction roll 14.

D: The wet paper web W did not move to the dryer fabric in the case of each of the degrees of vacuum in the suction roll 14.

Moreover, the wet paper web transfer belts with the evaluation A to C above can be considered to have excellent release property.

The results of the evaluations above are shown in Table 2.

TABLE 2

| | The state of the wet paper | | Evaluation of the wet paper web transfer properties | | | |
|---|---|---|---|---|---|---|
| | web carrying surface | | Immediately after installation | | After 3 days of operation | |
| | Rsk | Ra (μm) | adhesive | release | adhesive | release |
| Example 1 | −0.6 | 2.1 | C | C | B | C |
| Example 2 | −0.6 | 6.5 | C | A | C | B |
| Example 3 | −0.6 | 11.5 | C | A | C | A |

TABLE 2-continued

| | The state of the wet paper web carrying surface | | Evaluation of the wet paper web transfer properties | | | |
|---|---|---|---|---|---|---|
| | | | Immediately after installation | | After 3 days of operation | |
| | Rsk | Ra (μm) | adhesive | release | adhesive | release |
| Example 4 | −1.6 | 2.1 | B | C | B | C |
| Example 5 | −1.6 | 6.5 | B | A | B | A |
| Example 6 | −1.6 | 11.5 | C | A | C | A |
| Example 7 | −2.5 | 2.1 | A | C | A | C |
| Example 8 | −2.5 | 6.5 | A | A | A | A |
| Example 9 | −2.5 | 11.5 | A | A | A | A |
| Comparative Example 1 | −0.35 | 2.1 | D | C | C | D |
| Comparative Example 2 | −0.35 | 6.5 | D | A | D | C |
| Comparative Example 3 | −0.35 | 11.5 | D | A | D | B |

As shown in Table 2, the wet paper transfer belts relating to Example 1 to 9 have excellent adhesive and release properties both immediately after installation and after three days of operation. Moreover, the release property of the wet paper web transfer belts relating to Examples 1 to 9 are better after three days of operation than immediately after installation of the wet paper web transfer belt.

On the other hand, the wet paper web transfer belts relating to Comparative Examples 1 to 3 did not have sufficient adhesive and release properties. In particular, compared to immediately after installation, the release property had deteriorated after three days of operation.

Thus, the wet paper web transfer belts relating to Examples 1 to 9 had excellent wet paper web transfer properties, wherein the adhesive and release properties were excellent at the same time and the paper robbing phenomenon of the wet paper web was prevented in the press part.

DESCRIPTION OF THE REFERENCE CHARACTERS

1: Wet paper web transfer belt, 1*a*: Laminated body, 2: Papermaking system, 3: Press part, 4: Dryer part, 5,6: Press felt (felt), 7: Dryer fabric, 8: Guide rollers, 9: Shoe, 10: Press roll, 11: Shoe press belt, 12: Press section, 13: Shoe press mechanism, 14: Suction roll, 21: Reinforcing fiber base material layer, 211: Reinforcing fiber base material, 212: Resin, 22: $1^{st}$ Resin layer, 22*a*: $1^{st}$ Resin layer precursor, 221: Wet paper web carrying surface, 222: Convex portions, 223: Concave portions, 23: $2^{nd}$ Resin layer, 231: Roll contacting surface, 38: rolls, 39: Coater bar, 40: Resin discharge opening, 41: Polishing device, W: Wet paper web.

The invention claimed is:

1. A wet paper web transfer belt for transferring a wet paper web, comprising a resin layer providing a wet paper web carrying surface for carrying a wet paper web, wherein the skewness Rsk of a roughness curve of the wet paper web carrying surface is −0.5 or less.

2. The wet paper web transfer belt according to claim 1, wherein the Rsk is between −2.7 and −0.5.

3. The wet paper web transfer belt according to claim 1, wherein an arithmetic average roughness Ra of the wet paper web carrying surface is between 2.0 and 12.0 μm.

4. The wet paper web transfer belt according to claim 2, wherein an arithmetic average roughness Ra of the wet paper web carrying surface is between 2.0 and 12.0 μm.

5. A papermaking system comprising:

a press part including a closed draw for squeezing moisture from a wet paper web, wherein the wet paper web transfer belt according to claim 1 is positioned to pass a wet paper web in the closed draw.

6. The papermaking system according to claim 5, further comprising a felt provided such that the wet paper web may be passed in the closed draw between the wet paper web transfer belt and the felt.

* * * * *